United States Patent [19]

McCleerey

[11] Patent Number: 4,717,354

[45] Date of Patent: Jan. 5, 1988

[54] SOLDER CUP CONNECTOR

[75] Inventor: Earl W. McCleerey, Mechanicsburg, Pa.

[73] Assignee: AMP Incorporated, Harrisburg, Pa.

[21] Appl. No.: 818,431

[22] Filed: Jan. 13, 1986

Related U.S. Application Data

[63] Continuation-in-part of Ser. No. 672,632, Nov. 19, 1984, abandoned.

[51] Int. Cl.[4] ..... H01R 13/41; H01R 13/428

[52] U.S. Cl. ..... 439/444; 439/751; 439/874

[58] Field of Search ..... 339/220 R, 223 R, 275 B, 339/276 T, 278 T, 217 S, 220 C, 220 L, 220 T, 221 R, 221 M; 439/744–749, 751, 736, 869, 871–874, 865–867, 878, 884, 444

[56] References Cited

U.S. PATENT DOCUMENTS

| | | | |
|---|---|---|---|
| 2,832,816 | 4/1958 | Curtiss | 339/223 R |
| 2,925,577 | 2/1960 | Cetran et al. | 339/220 R |
| 3,411,130 | 11/1968 | Bushey | 339/220 R |
| 3,462,726 | 8/1969 | Stark et al. | 339/217 S |
| 3,544,954 | 12/1970 | Yeager | 339/217 S |
| 3,575,034 | 4/1971 | Lightner | 72/339 |
| 3,609,640 | 9/1971 | Longenecker et al. | 339/217 S |
| 3,718,895 | 2/1973 | Reynolds et al. | 339/258 R |
| 3,757,284 | 9/1973 | Klehm, Jr. | 339/221 R |
| 4,274,701 | 6/1981 | Bannert et al. | 339/217 S |
| 4,277,124 | 7/1981 | Loose et al. | 339/223 R |
| 4,379,611 | 4/1983 | Foege et al. | 339/217 S |
| 4,447,109 | 5/1984 | Hobart, Jr. | 339/275 B |
| 4,583,805 | 4/1986 | Mantlik | 339/217 S |
| 4,614,400 | 9/1986 | Tesch | 339/221 R |

FOREIGN PATENT DOCUMENTS

| | | | |
|---|---|---|---|
| 2386159 | 10/1978 | France . | |
| 2508243 | 12/1982 | France . | |
| 2539924 | 7/1984 | France . | |
| 292278 | 7/1965 | Netherlands . | |
| 2024539 | 1/1980 | United Kingdom | 339/221 M |

*Primary Examiner*—Gil Weidenfeld
*Assistant Examiner*—Gary F. Paumen
*Attorney, Agent, or Firm*—F. Brice Faller; David L. Smith

[57] ABSTRACT

Solder cup connector comprises stamped and formed terminals loaded into passages of a one-piece housing. Each terminal has a mating portion formed in a first direction from the plane of the stock, a solder cup formed in a second, opposite direction from the plane of the stock, and a transition portion crossing the axis of the terminal to align the mating portion and the solder cup. Flanges extending laterally from the transition portion bend to engage the side walls of a respective passage as a terminal is inserted therein, and further bite into the housing if withdrawal is attempted. The transition portion also serves as a barrier which prevents wicking of solder into the mating portion.

14 Claims, 5 Drawing Figures

12
56
10
22
14
52
26
30
18
34
50
54
20

12
10
56
22
14
48
52
30
34
50
54
18
58
46
60

SOLDER CUP CONNECTOR

This application is a continuation-in-part of U.S. application Ser. No. 672,632, filed Nov. 19, 1984, now abandoned.

Solder cup connectors are well known. These are often in the form of "D" connectors, such as the AMPLIMITE family of connectors sold by AMP Incorporated. Such connectors comprise a housing having a mating face, an opposed rear face, and a plurality of passages therebetween which receive respective electrical terminals. The terminals each have a mating portion in the form of a pin extending beyond the mating face or a socket immediately within the mating face, and a solder cup portion extending beyond the rear face. Termination is achieved by inserting the stripped end of a wire in the socket and applying solder, or alternately by reflowing solder already in the cup.

A problem with any solder cup terminal, is prevention of wicking into the mating protion during soldering. This not only coats plating but can fill a socket, rendering it useless. For board mounted terminals, this problem can be met with solder resist, as disclosed in U.S. Pat. No. 3,989,331, or enlarged structural features, as disclosed in U.S. Pat. No. 3,428,934 and U.S. Pat. No. 3,718,895. These solutions are either ineffective or impractical for the geometries of a D-connector. For D-connectors, the problem can be solved by use of a machined terminal having a barrier between the solder cup and the socket, but this is quite expensive. For stamped and formed terminals, inspection of the solder joint prior to final assembly of the terminal into the housing can assure that wicking has not occurred, but many users of solder cup D-connectors prefer applying wires to fully assembled connectors so they do not have to deal with loose piece terminals, which complicate harness manufacture. While testing can assure that wicking has not occurred, one defective joint can cause an assembly to be scrapped.

An important design consideration in such connectors is that the terminals must be capable of withstanding considerable axial force without retreating from the housing. Such force may be incurred during mating, as when a slightly skewed pin stubs the entry to a socket connector, or upon pulling a wire soldered into the cup. A common standard requires that the terminals withstand nine pounds pushing or pulling force.

The connector industry has met the retention problem in several ways. AMP Incorporated and some other manufacturers have provided a two-piece haousing and terminals which have an annular flange of larger diameter than the rest of the terminal. The flange is captured between the housing halves, the terminals first being assembled in the mating half of the housing, the rear half being assembled subsequently. The housing halves are then held together by a formed metal shield in two pieces, the pieces being fixed by rivets. A similar solution employs plastic retaining tines in the rear housing half, which tines engage a flange on the terminal. This variation permits inspecting the solder joints prior to inserting the terminal in the rear face of an assembled two-piece housing, and further by use of a special tool permits withdrawing any terminal. In addition to requiring a two-piece housing, a complex molding for the rear housing half is needed.

Another solution to the retention problem, provided by ITT Cannon, involves a one-piece housing with terminals received in the rear face, but requires a resilient C-ring in the passage. The ring expands as the mating end of the terminal is pushed therethrough, and snaps over a flange on the terminal while remaining large enough to prevent withdrawal. Another manufacturer provides a housing, terminals, and epoxy to retain the terminals.

According to the invention, each terminal is stamped and formed from standard metal strip stock with a mating portion in the form of a pin or a socket formed in a first direction from the plane of the stock. The solder cup is formed in a second, opposite direction from the plane of the stock, and a transition portion crosses the axis of the terminal between the mating portion and the solder cup portion to axially align same. A pair of opposed flanges extend laterally from the transition portion, which flanges bend to engage the sidewalls of a passage during insertion into the rear face of a one-piece housing. This retention means is found to be vastly superior to a conventional interference fit, and in combination with conventional pointed interference flanges adjacent the solder cup readily meet a high axial retention force standard.

Since the novel solder cup terminal having a transition portion with laterally extending flanges provides required retention in a one-piece housing, a manufacturing advantage accrues. The terminal may be partially inserted into a row of passages en masse while still attached to a carrier strip, and the strip severed before fully inserting by tooling in the form of pins which bear on respective transition portions. Typically, the terminals are stamped and formed at 0.217 inch centers from the strip stock, so that two strips would be stacked as taught in U.S. Pat. No. 4,021,095 to achieve the 0.109 inch centers required for terminals in a D-connector.

U.S. Pat. No. 4,379,611 assigned to the Hughes Aircraft Company, discloses a connector having box type socket contacts received in the mating face of a housing, the contacts each having a pin extending from the rear face. The patent refers to a terminal having a solder cup in lieu of a pin, which terminal is known and employs a transition portion crossing the axis of the terminal. Retention in the housing is provided by a lance on the socket which engages an aperture in the side of the housing to prevent withdrawal from the mating face. This retention concept would be unsuitable for a D-connector, since pins must be closely received through the mating face for stability, and sockets must be protected by a restricted entry at the mating face.

The present invention thus not only provides means for preventing solder wicking, but provides a novel retention means meeting high withdrawal force requirements, which means obviates the need for a two-piece housing. The economy of manufacture so achieved, and further the economics for the user made possible by eliminating the solder wicking problem, make this connector desirable for many applications.

BRIEF DESCRIPTION OF THE DRAWINGS

Referring to FIG. 1, the subject terminal 10 is stamped and formed from standard metal strip stock and has a mating portion 12, a transition portion 14, first retention means having lateral flanges 24, 26, second retention means having sidewalls 28, 30, and a solder cup 20.

Figure 1:
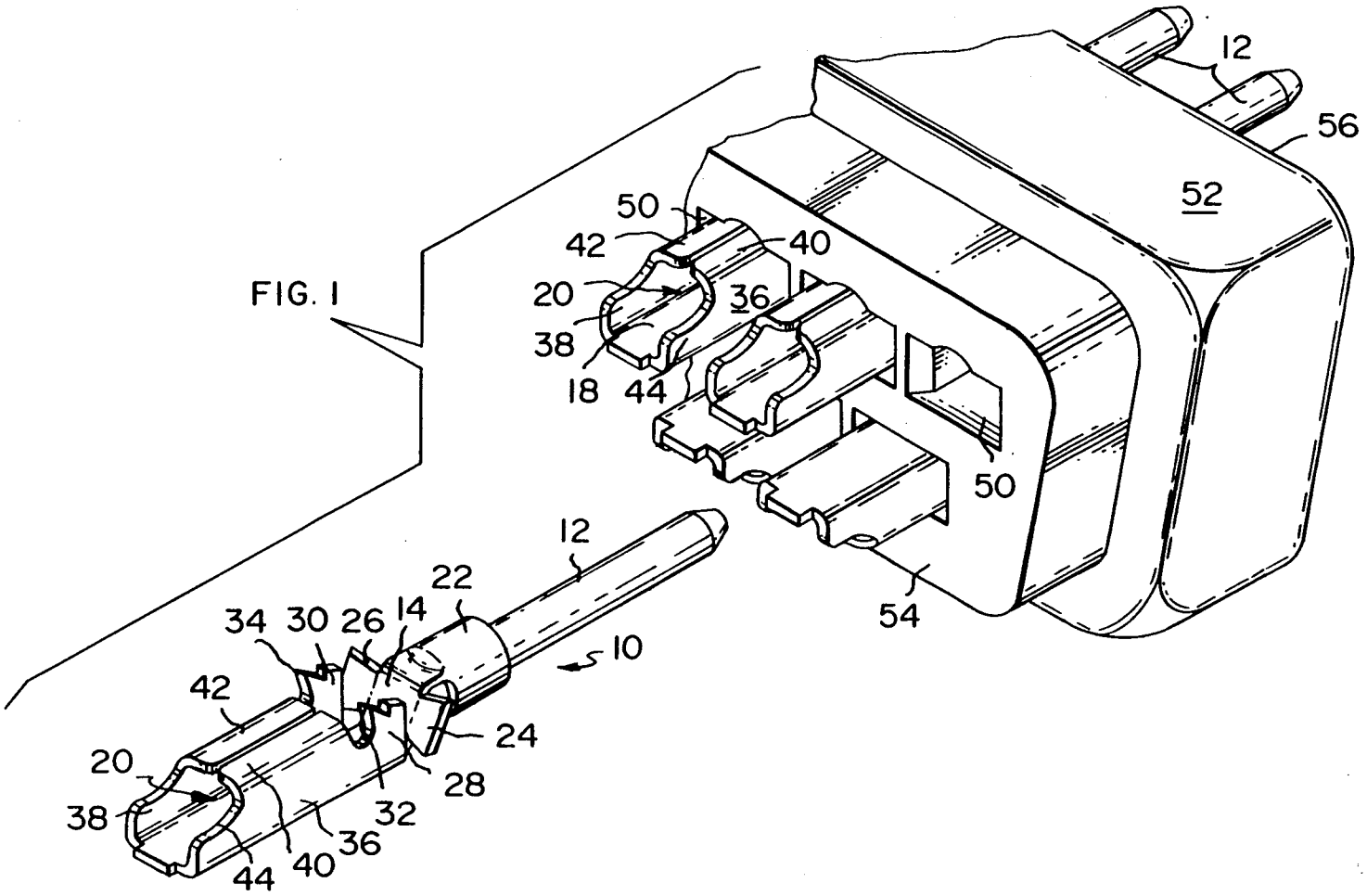
FIG. 1 is a perspective view of a terminal exploded from the housing.

The mating portion is shown as a pin 12 extending forwardly from a body 22, but a socket could likewise be used. The body 22 is formed coaxially of the terminal 10, and together with the mating portion 12 is formed in a first direction from the plane of the stock. The transition portion 14 traverses the axis of the terminal and has flanges 24, 26 extending from opposite sides of the axis of the terminal. The transition portion 14 lies between the sections of the terminal formed in opposite directions from the plane of the stock. The side walls 28, 30 and solder cup 20 are formed in the opposite direction from the plane of the stock. The second retention means is generally channel-shaped having a base 18 and a pair of side walls 28, 30, each of which has a pair of sharp points 32, 34.

The solder cup 20 is a closed barrel formed by base 18, side walls 36, 38, and top wals 40, 42. An open entry 44 facilitates insertion of a wire 46 and application of solder 48 (FIG. 3).

Figure 2:
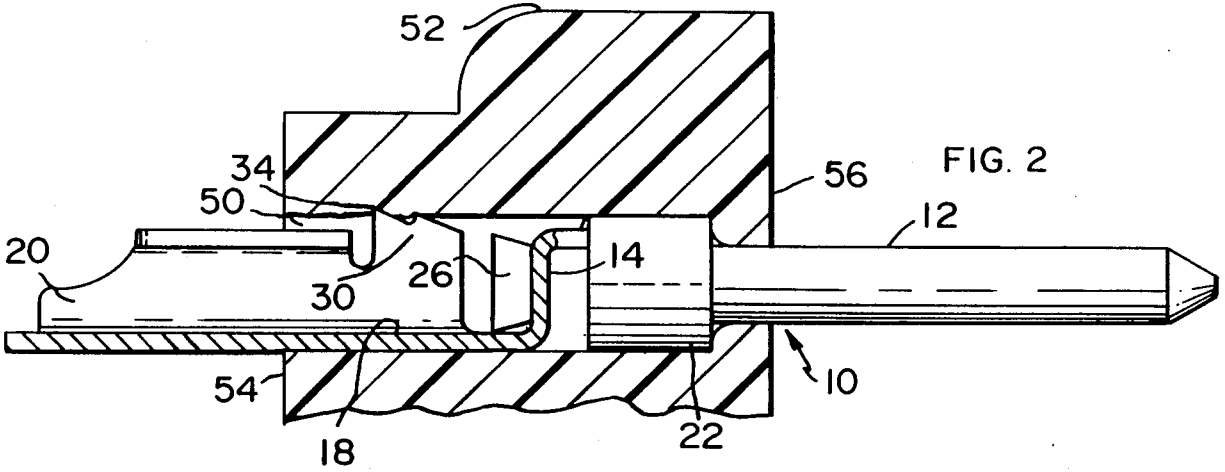
FIG. 2 is a partial side section of the connector prior to application of a wire and solder to the terminal.

Referring to FIG. 2, terminal 10 is mounted in a passage 50 of housing 52, the passage 50 extending between a rear face 54 and a mating face 56 with a pin 12 projecting beyond the mating face 56 while the solder cup 20 extends from the rear face 54. The housing 52 is molded in one piece of dielectric such as thermoplastic. Note that the transition portion 14 is substantially normal to the axis of the passage, since it is borne against by a pin during insertion.

Figure 3:
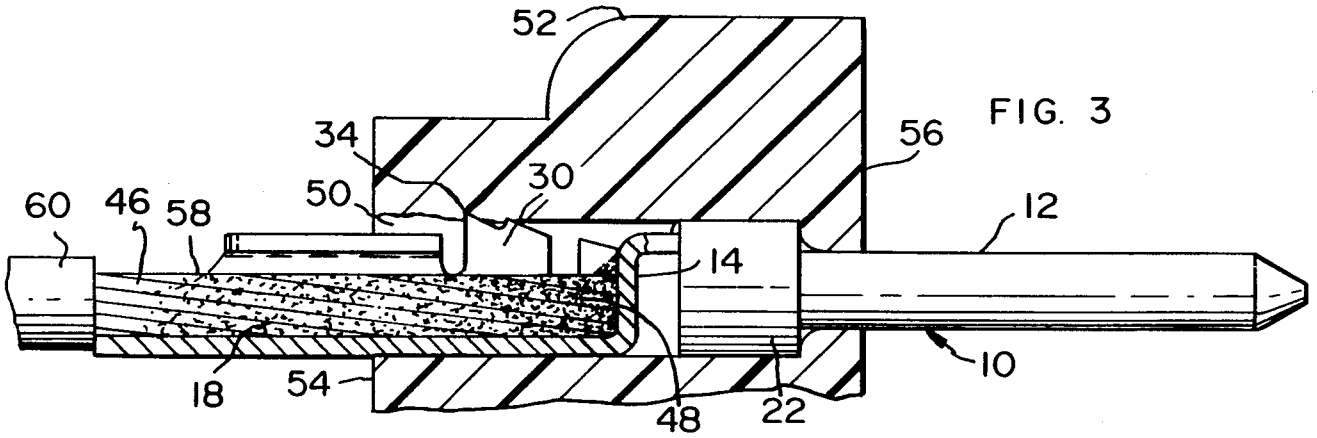
FIG. 3 is a partial side section of the connector after termination and soldering to an associate wire.

FIG. 3 shows a wire 46 joined to the subject terminal. The bared conductors 58 are inserted into the solder cup 20 and the penetration can be stopped by the insulation 60 abutting the solder cup 20 or by the conductors 58 abutting the transition portion 14. The depth to which the conductors 58 can be inserted also provides holding means for the wires during soldering. Solder 48 is then applied to secure the wire in the terminal, the transition portion 14 preventing wicking of solder into the mating portion 12.

It will also be noted from FIGS. 2 and 3 that the body 22 serves to position the terminal within the housing 52 while the first retention means flanges 24, 26 bend to engage the material of the housing on the sides of the passage 50. Points 32, 34 on the free edges of walls 28, 30 of the second retention means bite into the top of the passage to prevent withdrawal of the terminal. Pushing on the pin 12 or pulling on the wire 46 causes the flanges 24, 26 to bend to invert to bite into the side walls. Both sets of retention means also serve to stabilize the terminal 10 within the housing 52. The points 32, 34 are in a conventional interference fit, i.e., they plough through plastic during insertion of the terminal, and the plastic flows around the points 32, 34 for retention.

Figure 4:
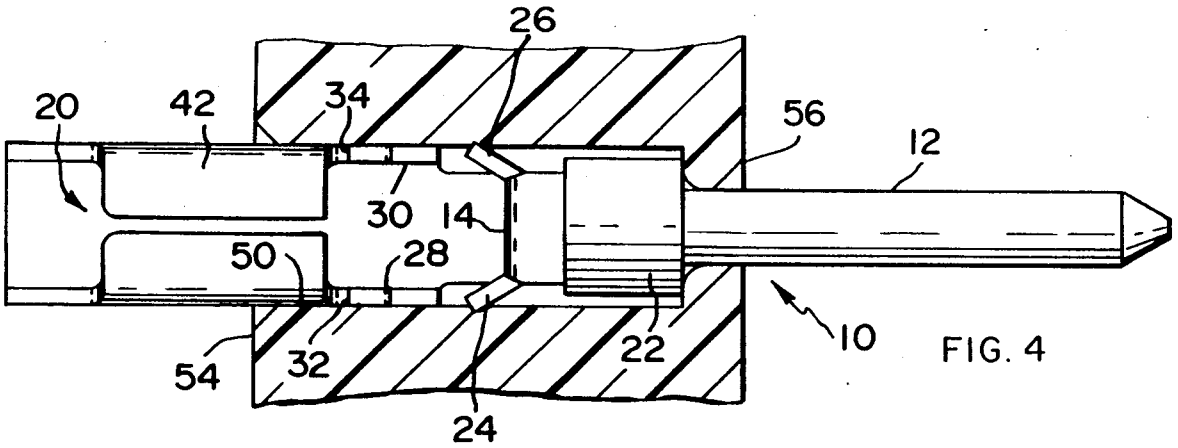
FIG. 4 is a partial section plan view.

Referring to FIG. 4, the operation of flanges 24, 26 is more apparent. During insertion, the flanges 24, 26 bend against the side walls of the passage. Due to their resilience, they bite into the plastic as shown when fully inserted. If force is applied to the pin 12 during mating, or if withdrawal is attempted after termination, the flanges 24, 26 invert to bite into the side walls, and will skive considerable plastic if withdrawn. Note in other figures that the distal ends of the flanges 24, 26 are wider than the necks where they attach to the transition portion 14, whereby retention is maximized.

Figure 5:
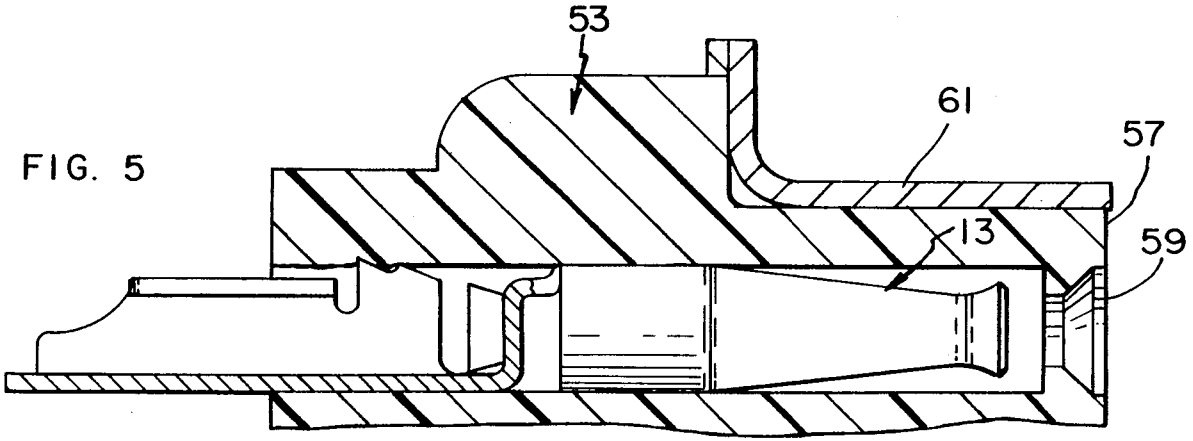
FIG. 5 is a partial side section of alternative embodiment.

FIG. 5 depicts the solder cup embodiment, which is similar but for having a seating portion in form of a socket 13, and a housing 53 having mating face 57 with restricted entries 59 which serve as guides for pins projecting from a complementary connector. The shield 61 is conventional, and could likewise be installed on the embodiment of FIGS. 1 to 4 in known fashion.

It was found during testing that the flanges 24, 26 provide about ten pounds of retention force while the walls 28, 30 provide an additional ten pounds. Since each pair of flanges acts on a different pair of opposed side walls of the passage, the retention force is cumulative to yield twenty pounds retention, i.e., twenty pounds push or pull required to unseat a terminal. This, of course, will vary within manufacturing tolerances, the worst case being an undersized terminal in an oversized passageway. In all cases, retention force well in excess of the nine pound standard requirement was met during testing.

The foregoing is exemplary and not intended to limit the scope of the claims which follow.

What is claimed is:

1. A solder cup connector comprising an insulative housing having a mating face, an opposed rear face, and a plurality of passages therethrough from said mating face to said rear face, said passages having respective electrical terminals mounted therein, each terminal being stamped and formed from standard metal strip stock, each said terminal comprising a mating portion formed in a first direction from the plane of the stock material, a solder cup portion formed in a second, opposite direction from the plane of the stock material, and a transition portion therebetween, said transition portion crossing the longitudinal axis of the terminal to axially align the mating portion and the solder cup portion, said connector being characterized by a one-piece housing, said terminals being inserted in respective passages from said rear face, each said terminal having first retention means comprising a pair of opposed flanges extending laterally from the transition portion, said flanges bending to engage the side walls of the passage during insertion, said flanges serving to retain said terminals against withdrawal from said rear face.

2. A solder cup connector as in claim 1, said terminal being further characterized by second retention means comprising a channel shaped portion formed in said second direction, said channel shaped portion having spaced walls, said walls having free edges providing an interference fit in the respective passage.

3. A solder cup connector as in claim 2, wherein each wall of said channel shaped portion has a pair of points at the free ends thereof, which points provide said interference fit in the respective passage.

4. A connector as in claim 1 wherein said connector is a D-connector. each said terminal comprising a mating portion formed in a first direction from the plane of the stock material, a solder cup portion formed in a second, opposite direction from the plane of the stock material, and a transition portion therebetween, said transition portion crossing the longitudinal axis of the terminal to axially align the mating portion and the solder cup portion, said connector being characterized by a one-piece housing, said terminals being inserted in respective passages from said rear face, each said terminal having first retention means comprising a pair of opposed flanges extending laterally from the transition portion, said flanges bending to engage the side walls of the passage during insertion, said flanges serving to retain said terminals against withdrawal from said rear face.

5. A solder cup connector as recited in claim 1 wherein the distal ends of the flanges are wider than the necks where they are attached ot the transition portion.

6. A solder cup connector as recited in claim 1 wherein the mating portion is in the form of a pin.

7. A solder cup connector as recited in claim 1 wherein the mating portion is in the form of a socket.

8. An electrical terminal for insertion into a passage in a dielectric housing, comprising:

a contact section;

a terminal section;

a transition section between the contact section and the terminal section, said transition section crossing the longitudinal axis of the terminal and extending at an angle to the longitudinal axis to opposed flanges extending laterally from the transition section, whereby upon insertion of the terminal into the passage the flanges bend to engage the passage walls thereby securing the terminal in the passage.

9. An electrical terminal as recited in claim 8 wherein the distal ends of the flanges are wider than the necks where they are attached to the transition section.

10. An electrical terminal as recited in claim 8 wherein the contact section is in the form of a pin.

11. An electrical terminal as recited in claim 8 wherein the contact section is in the form of a socket.

12. An electrical terminal as recited in claim 8 further comprising said terminal section having spaced walls with scalloped edges, whereby upon insertion of the terminal into the passage the scalloped edges provide an interference fit that supplements retention of the terminal in the passage by the flanges.

13. An electrical connector assembly, comprising an insulative housing having passages extending therethrough;

each of said passages having an electrical terminal secured therein;

said terminal comprising, a contact section;

a terminal section;

a transition section between the contact section and the terminal section, said transition section crossing the longitudinal axis of the terminal and extending at an angle to the longitudinal axis to axially align the contact section and the terminal section; and opposed flanges extending laterally from the transition section, whereby upon insertion of the terminal into the passage the flanges bend to engage the passage walls thereby securing the terminal in the passage.

14. An electrical connector assembly as recited in claim 13 wherein said terminal section further comprises spaced walls with scalloped edges that provide an interference fit with the passage walls, whereby upon insertion of said terminal into said passage the scalloped edges provide an interference fit that supplements retention of said terminal in said passage by the flanges.

* * * * *